US008753175B2

(12) United States Patent
Chen et al.

(10) Patent No.: US 8,753,175 B2
(45) Date of Patent: Jun. 17, 2014

(54) POSITION ADJUSTMENT MECHANISM OF GRINDING WHEELS

(75) Inventors: Po-Chung Chen, Guanyin Township, Taoyuan County (TW); Toshiharu Nakata, Guanyin Township, Taoyuan County (TW); Ming-Chin Wang, Guanyin Township, Taoyuan County (TW)

(73) Assignee: Green Energy Technology Inc., Taipei (TW)

( * ) Notice: Subject to any disclaimer, the term of this patent is extended or adjusted under 35 U.S.C. 154(b) by 546 days.

(21) Appl. No.: 13/067,714

(22) Filed: Jun. 22, 2011

(65) Prior Publication Data

US 2012/0214388 A1 Aug. 23, 2012

(30) Foreign Application Priority Data

Feb. 18, 2011 (TW) ..... 100203035 U

(51) Int. Cl.
*B24B 5/01* (2006.01)

(52) U.S. Cl.
USPC ..... 451/342; 451/464; 451/483

(58) Field of Classification Search
USPC ..... 451/342, 359, 464, 482, 483, 548
See application file for complete search history.

(56) References Cited

U.S. PATENT DOCUMENTS

| | | | | |
|---|---|---|---|---|
| 2,309,016 | A * | 1/1943 | Ryan | 451/548 |
| 3,574,974 | A * | 4/1971 | Weissing | 451/397 |
| 4,907,374 | A * | 3/1990 | Brill | 451/342 |
| 6,179,695 | B1 * | 1/2001 | Takahashi et al. | 451/287 |
| 6,220,931 | B1 * | 4/2001 | Nishi et al. | 451/28 |
| 6,336,849 | B1 * | 1/2002 | Konnemann | 451/259 |
| 6,375,542 | B1 * | 4/2002 | Kashchenevsky | 451/24 |
| 6,386,956 | B1 * | 5/2002 | Sato et al. | 451/57 |
| 6,905,398 | B2 * | 6/2005 | Jeong | 451/57 |
| 7,014,540 | B2 * | 3/2006 | Nagel | 451/57 |
| 7,014,542 | B1 * | 3/2006 | Lu | 451/65 |
| 7,261,621 | B2 * | 8/2007 | Moon et al. | 451/287 |
| 2005/0020198 | A1 * | 1/2005 | Nagel | 451/548 |
| 2006/0009134 | A1 * | 1/2006 | Katayama | 451/41 |
| 2012/0196518 | A1 * | 8/2012 | Chen et al. | 451/463 |

FOREIGN PATENT DOCUMENTS

JP 2011051028 A * 3/2011

* cited by examiner

*Primary Examiner* — Eileen P. Morgan
(74) *Attorney, Agent, or Firm* — Bacon & Thomas, PLLC

(57) ABSTRACT

A position adjustment mechanism for grinding wheels includes a rotating body, a first grinding unit, a second grinding unit, and a fixing nut. The rotating body includes a fixing surface and a first thread portion. The first grinding unit includes a first grinding portion and a fixing portion fixedly engaged with the fixing surface. The second grinding unit includes a second thread portion, which is threadedly engaged with the first thread portion of the rotating body, and a second grinding portion which is spaced from the first grinding portion and which has a different grinding precision from that of the first grinding portion. The fixing nut is threadedly engaged with the first thread portion, and presses axially against the second grinding unit. Thereby, a rough grinding and a fine grinding can be accomplished together within a grinding process, and adjustment on a spacing between the two grinding wheels becomes easy.

7 Claims, 5 Drawing Sheets

POSITION ADJUSTMENT MECHANISM OF GRINDING WHEELS

BACKGROUND OF THE INVENTION

1. Field of the Invention

The present invention relates to a position adjustment mechanism, and more particularly, to a mechanism for adjusting the position of grinding wheels.

2. Description of Related Art

Currently grinding facilities have been widely adopted, particularly use of grinding wheels can be seen in manufacturing factories such that surfaces of ground workpieces can be polished and smooth. Accordingly, grinding wheels are widely welcomed by public consumers. Among grinding wheels, sand wheels are used more widely.

For conventional sand wheels, diameters of abrasive grains in a sand wheel are approximately the same. Therefore, in case people intend to proceed with mirror grinding for workpieces, they need to perform, in sequence, a rough grinding process and then a fine grinding process so as to obtain ground workpieces as desired. In other words, working processes with sand wheels having abrasive grains of various diameters are necessary.

However, it is cumbersome for those who proceed with the above-mentioned working processes. If a rough-grinding sand wheel and a fine-grinding sand wheel use the same driving device, steps attaching and detaching the sand wheels are required. In these occasions, people have to take into account of the problems, when attaching and detaching the sand wheels, such as dynamic balance, concentricity, roundness, and so forth. Taking care of these problems is of very much time consuming.

Further, in another design of the conventional art, two sand wheels of different specifications are mounted in the same grinding machine on two individual driving devices. For example, as shown in FIG. 1, a perspective view illustrating a conventional grinding machine with dual sand wheels, the grinding machine has two sand wheels 1,2 driven by different motors 3,4. Such arrangement, though saves the cumbersome steps of attaching and detaching the sand wheels, still requires, as the conventional art mentioned above, two machining steps, i.e. rough grinding and fine grinding. Nevertheless, both the above-mentioned two conventional designs need an end-measuring step prior to the fine grinding and after the rough grinding so as to precisely locate a starting position for the fine grinding step. This, however, not only adds burden on working procedure, but also runs a potential risk on erroneous end-measurements.

Accordingly, the conventional grinding machines, as mentioned above, have a poor practicality, and as such, improvement thereto is necessary.

SUMMARY OF THE INVENTION

A primary object of the present invention is to provide a position adjustment mechanism for grinding wheels, so that on the one hand, working steps can be decreased, and on the other, positions of the grinding wheels can be adjusted easily.

To achieve the object, the position adjustment mechanism for grinding wheels, according to the present invention, comprises a rotating body, a first grinding unit, a second grinding unit, and a fixing nut. The rotating body includes a fixing surface and a first thread portion.

Further, the first grinding unit includes a fixing portion and a first grinding portion, wherein the fixing portion is fixedly engaged with the fixing surface. The second grinding unit includes a second thread portion and a second grinding portion, wherein the second thread portion is threadedly engaged with the first thread portion. The first and the second grinding portions have different diameters from each other, and are spaced from each other axially, and have different grinding precision.

According to the present invention, the fixing nut is threadedly engaged with the first thread portion, and presses axially against the second grinding unit.

Through the above-mentioned structure, not only energy and facility cost can be saved by only using one single driving device to drive the two grinding wheels, but also a rough grinding and a fine grinding can be accomplished within a grinding process. Besides, adjustment on the spacing between the two grinding wheels is very easy.

According to a preferred embodiment of the present invention, the second grinding unit may include a sand wheel and an adjustment base, wherein the sand wheel is coaxially fixed on the adjustment base. The adjustment base has a hollow structure, and the second thread portion is formed at an inner wall of the hollow structure. In addition, the rotating body may further include a motor spindle and a flange, wherein the flange is coaxially arranged on an end of the motor spindle. Both the fixing surface and the first thread portion are located on a surface of the flange. In case both the grinding wheels include sand wheels, then the first grinding unit has a diameter of abrasive grains smaller than the second grinding unit has.

Further, according to another preferred embodiment of the present invention, a rotating body may further include a motor spindle, a flange, and an adjustment base, wherein the flange is coaxially fastened to an end of the motor spindle, and has a thread recess such that the adjustment base is threadedly engaged into the thread recess. The first thread portion is located at circumference of the adjustment base, and the fixing surface at a surface of the flange. In this aspect of design, the first and the second grinding units may each include a sand wheel such that the first grinding unit has a diameter of abrasive grains greater than the second grinding unit has.

Still further, according to the present invention, the rotating boy may internally be provided with a slurry channel for flowing grinding slurry therethrough.

Other objects, advantages, and novel features of the present invention will become more apparent from the following detailed description when taken in conjunction with the accompanying drawings.

DETAILED DESCRIPTION OF THE PREFERRED EMBODIMENTS

Figure 1:
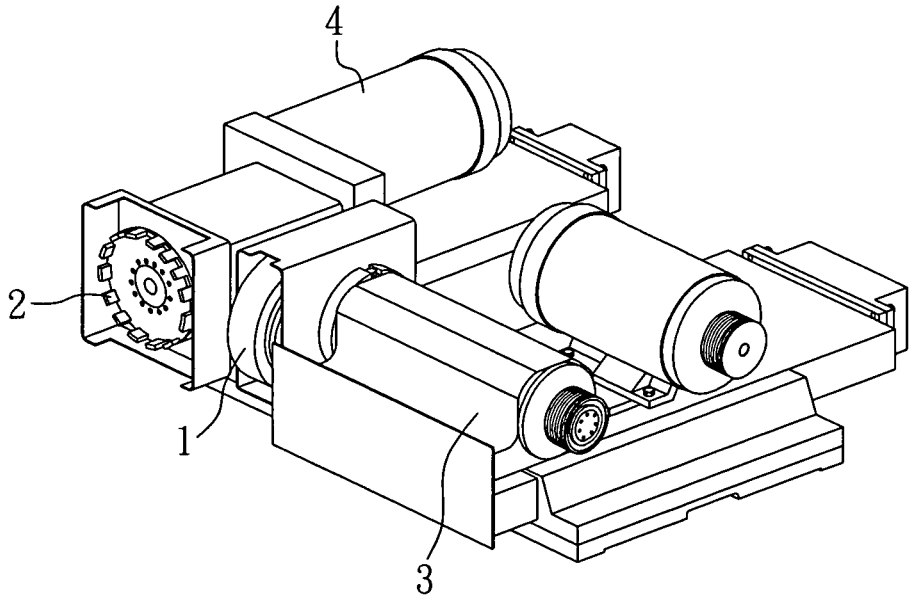
FIG. 1 (PRIOR ART)
FIG. 1 is a perspective view illustrating a conventional grinding machine with dual sand wheels.
Figure 2:
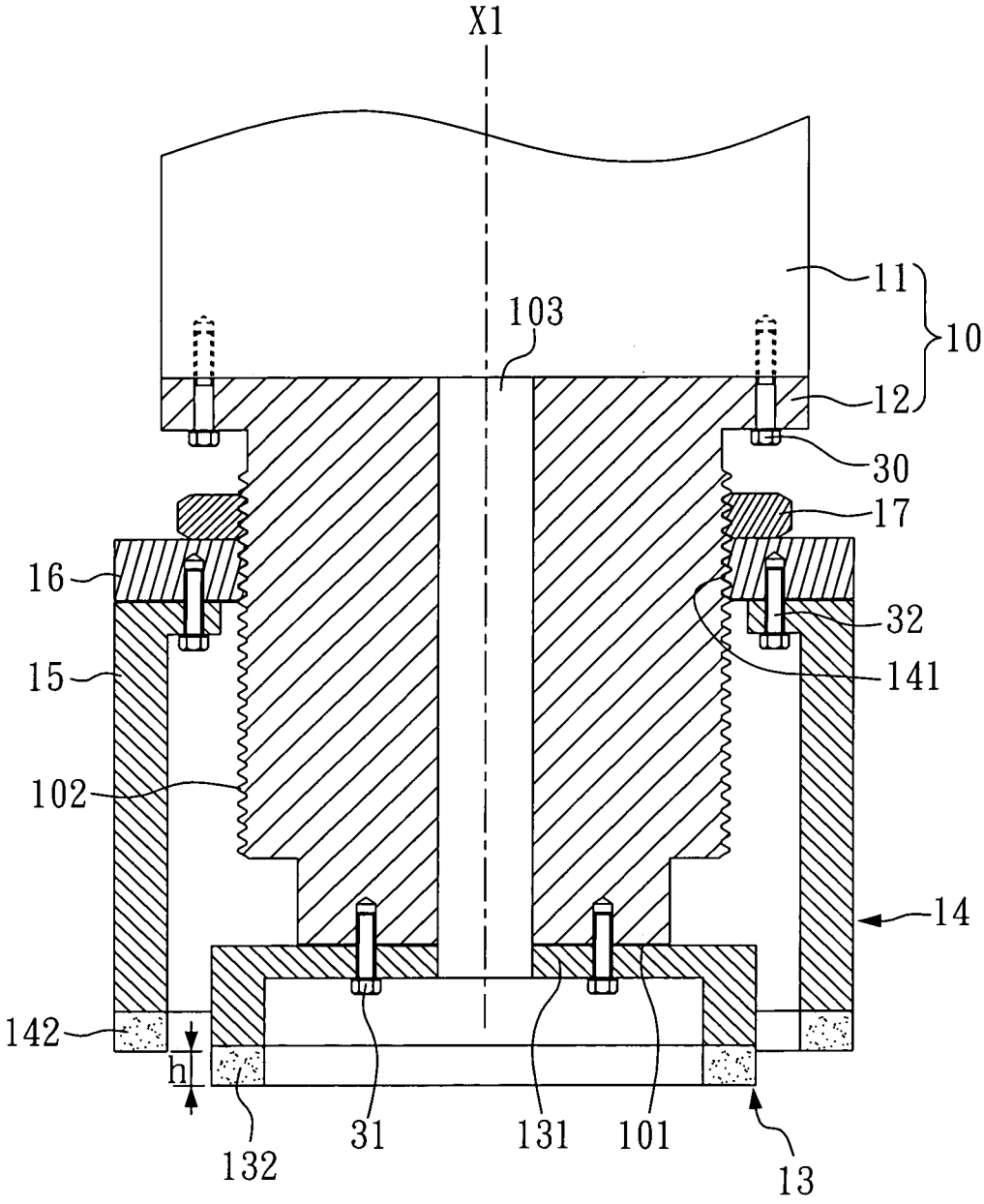
FIG. 2 is a cross-sectional view illustrating a position adjustment mechanism of grinding wheels according to a first embodiment of the present invention.
Figure 3:
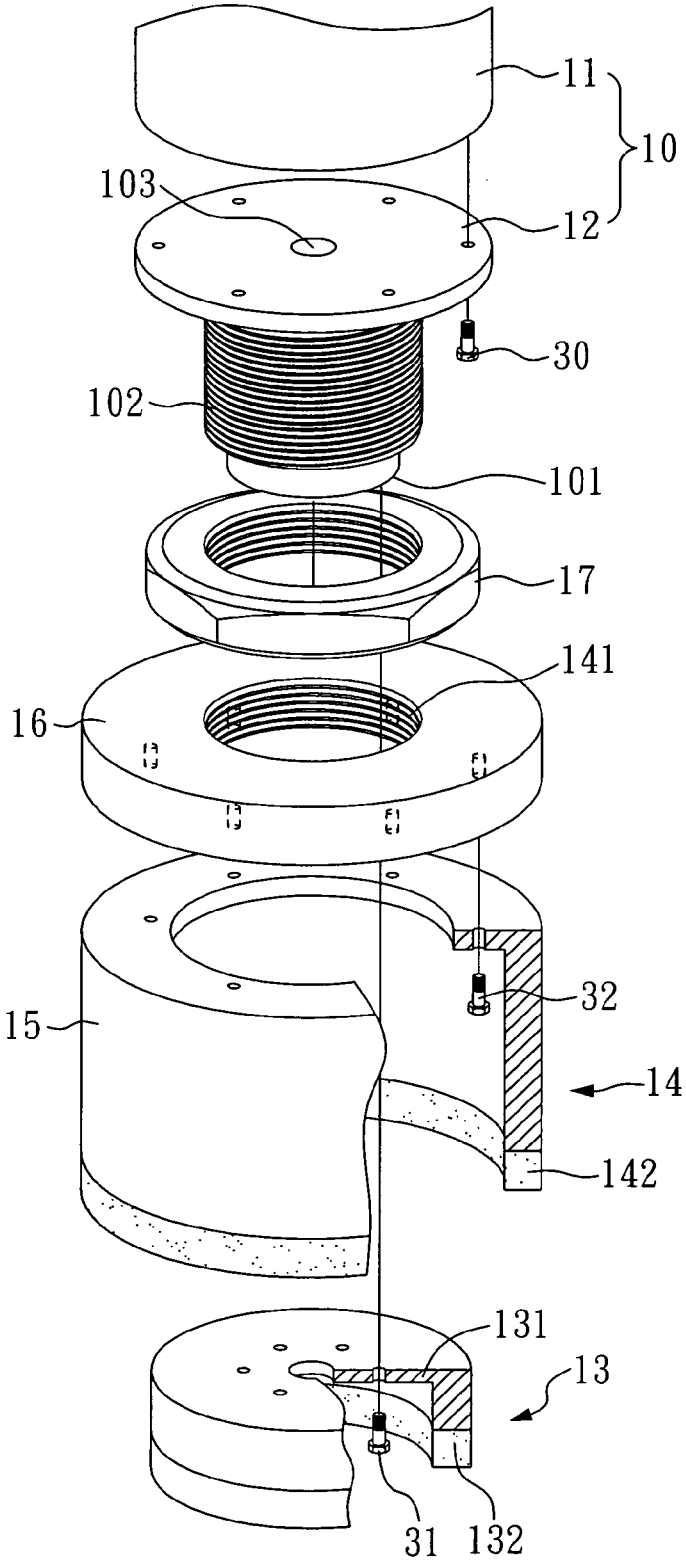
FIG. 3 is an exploded view illustrating the position adjustment mechanism of grinding wheels according to the first embodiment of the present invention.

A simplified design exemplification for a position adjustment mechanism of grinding wheels, according to the present invention, lies in that on the one hand, a first grinding unit is fixed on a rotating body, and on the other, a second grinding unit is threadedly engaged with the rotating body, so that workpieces can be ground by the two grinding units driven by the same rotating body. In addition, a fixing nut is also threadely engaged with the rotating body, and presses axially against the second grinding unit. Preferred embodiments in this regard are described in detail as follows:

Referring to FIGS. 2 and 3, cross-sectional and exploded views illustrating a position adjustment mechanism of grinding wheels according to a first embodiment of the present invention, the position adjustment mechanism comprises, among others, a rotating body 10, consisting of a motor spindle 11 and a flange 12 and provided for driving grinding wheels, wherein the flange 12 is threadedly engaged on an end of the motor spindle 11 by bolts 30 such that the flange 12 and the motor spindle 11 are coaxially arranged so as to rotate synchronously. The flange 12, at its axial end, is formed with a fixing surface 101; while, at its circumference, with a first thread portion 102; and through its center, with a slurry channel 103 for flowing grinding slurry therethrough.

In the present embodiment, the position adjustment mechanism of grinding wheels is provided with a first grinding unit 13 relating, itself, to a cup-like sand wheel, where a first grinding portion 132 is formed at an end surface of the sand wheel for grinding workpieces; while a fixing portion 131 is formed at a bottom of the sand wheel for being fixedly engaged, by bolts 31 as well, with the fixing surface 101 of the flange 12. Such, therefore, constitutes a coaxial assembly of the first grinding unit 13 and the flange 12.

Further, the position adjustment mechanism of grinding wheels is provided with a second grinding unit 14 consisting of a cup-like sand wheel 15 and an adjustment base 16, wherein the adjustment base 16 has a hollow structure, and at an inner wall of the hollow structure there is formed with a second thread portion 141. The sand wheel 15 is coaxially fixed on an axial surface of the adjustment base 16 by bolts 32 as well. The second thread portion 141 of the adjustment base 16 is threadedly engaged with the first thread portion 102 of the flange 12, so that the second grinding unit 14 can be coaxially assembled to the flange 12.

In the present embodiment, the sand wheel 15 has a second grinding portion 142 having a diameter of abrasive grains greater than that of the first grinding portion 132. That is to say, the second grinding portion 142 has a lower grinding precision. The sand wheel 15 has a diameter greater than that of the first grinding unit 13, and hence the second grinding portion 142, as compared with the first grinding portion 132, is farther away from an axis X1 of the rotating body 10. In addition, the first grinding portion 132, as compared with the second grinding portion 142, extends downward further in an axial direction. A spacing h between the first and the second grinding portions 132,142 is determined by requirement in application. The spacing h refers to a distance away from an outmost end surface (free end surface) of the first grinding portion 132 to an outmost end surface of the second grinding portion 142.

A fixing nut 17 is threadedly engaged with the first thread portion 102 of the flange 12, and pressess axially against the adjustment base 16 of the second grinding unit 14, so that phenomena of vibration and noise resulted from an inevitable thread gap between the adjustment base 16 and the flange 12 can be eliminated.

Through the above-mentioned structure, when proceeding with a grinding work after selecting desired match between abrasive grains of the first and the second grinding portions 132,142 and the spacing h between them, the grinding machine will first perform a rough grinding on a workpiece with the outside-located second grinding portion 142, and then with the first grinding portion 132 for a fine grinding. Therefore, within a single grinding stroke, both a rough and a fine grinding processes can be accomplished, not only time and efforts are saved, but also a more precise grinding outcome can be obtained.

Further, according to the present invention, when the sand wheels are worn out and replacements thereof are required, where the spacing h between the two grinding portions 132, 142 needs to be readjusted or reset, only turning the adjustment base 16 will make the second grinding portion 142 move relative to the first grounding portion 132, as such, the adjustment process is very easy and convenient.

Figure 4:
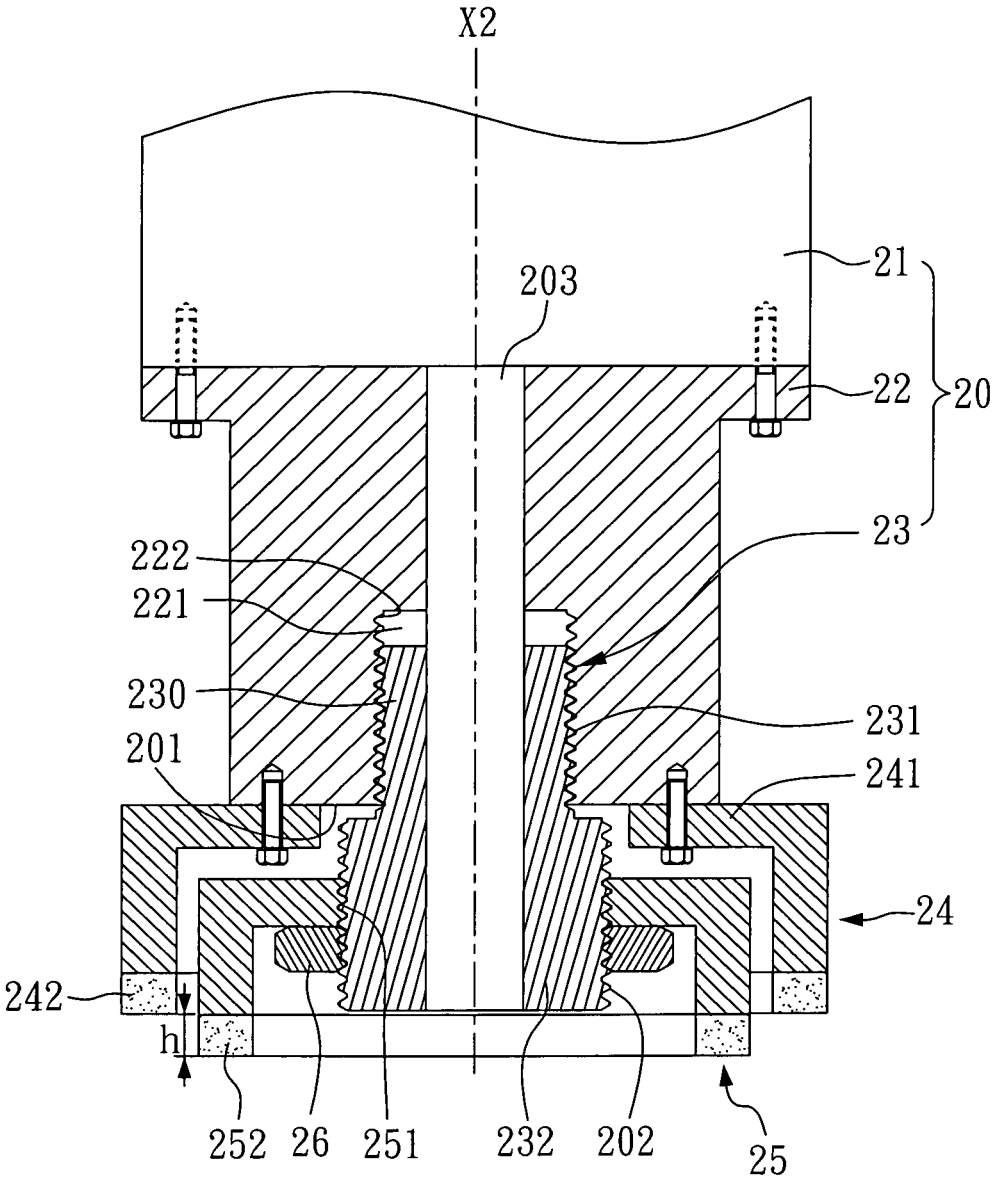
FIG. 4 is a cross-sectional view illustrating a position adjustment mechanism of grinding wheels according to a second embodiment of the present invention.
Figure 5:
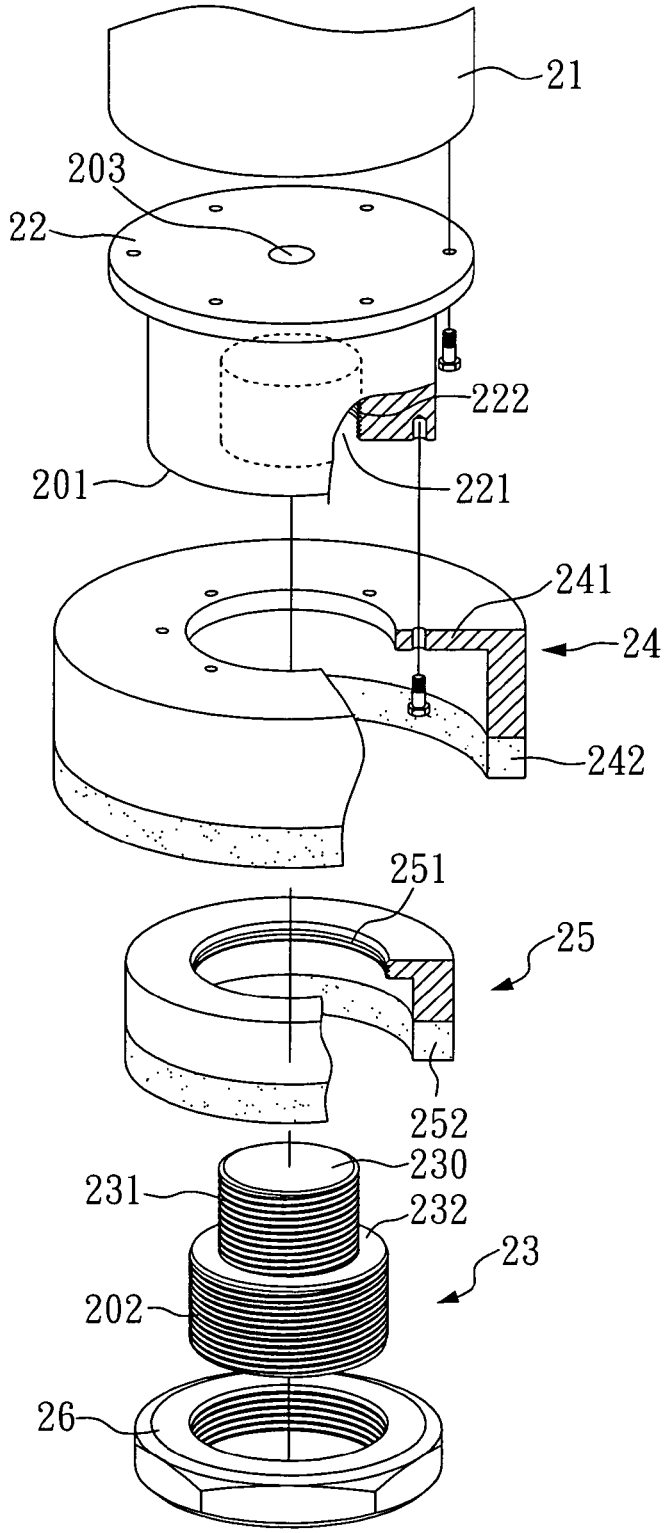
FIG. 5 is an exploded view illustrating the position adjustment mechanism of grinding wheels according to the second embodiment of the present invention.

Now referring to FIGS. 4 and 5, cross-sectional and exploded views illustrating a position adjustment mechanism of grinding wheels according to a second embodiment of the present invention, in the second embodiment the position adjustment mechanism, similarly, comprises a rotating body 20, a first grinding unit 24, a second grinding unit 25, and a fixing nut 26. The rotating body 20 consists of a motor spindle 21, a flange 22, and an adjustment base 23. The flange 22, as in the first embodiment, has an end surface threadedly fastened to an end of the motor spindle 21. In particular, the flange 22 is formed axially, at a center of the other end, with a thread recess 221 such that wall of the thread recess 221 is formed with a fourth thread portion 222. A fixing surface 201 is formed at an area surrounding an opening of the thread recess 221. The flange 22 and the adjustment base 23 are each provided, centrally, with a through passage so as to form a hollow structure. These two passages constitute together a slurry channel 203 for flowing grinding slurry therethrough.

The adjustment base 23 consists of a small diameter portion 230 and a large diameter portion 232, wherein a third thread portion 231 is formed at circumference of the small diameter portion 230, and a first thread portion 202 at circumference of the large diameter portion 232 such that the third thread portion 231 is threadedly engaged into the thread recess 221 of the flange 22.

In the second embodiment, the first grinding unit 24 relating, itself, to a cup-like sand wheel, is formed, at an end surface of the sand wheel, with a first grinding portion 242 for grinding workpieces; while a fixing portion 241 is formed at a bottom of the sand wheel for being fixedly engaged, also by bolts, with the fixing surface 201 of the flange 22.

The second grinding unit 25, also relating to a cup-like sand wheel, has a second grinding portion 252 wherein the center thereof is provided with a hollow structure such that a second thread portion 251 is formed at wall of the hollow structure. The second thread portion 251 of the second grinding unit 25 is threadedly engaged with the first thread portion 202 of the adjustment base 23.

Further, the first grinding portion 242 has a diameter of abrasive grains greater than that of the second grinding portion 252, namely, the second grinding portion 252 has a higher grinding precision. The first grinding unit 24 also has a diameter greater than that of the second grinding unit 25, namely, the first grinding portion 242 is farther away from an axis X2 of the rotating body 20 than the second grinding portion 252. The second grinding portion 252 extends, in an axial direction, further downward than the first grinding portion 242, and there is a spacing h between the first and the second grinding portions 242,252. The fixing nut 26 is threadedly engaged with the first thread portion 202, and presses against the second grinding unit 25 axially.

Of course, the first grinding unit 24, the second grinding unit 25, and the fixing nut 26 are all co-axially arranged with the rotating body 20. Like in the first embodiment, the fixing nut 26 is threadedly engaged with the first thread portion 202, and presses against the second grinding unit 25 axially.

The structure in this second embodiment can also accomplish both a rough and a fine grinding processes within a single grinding stroke. Besides, when adjusting the spacing h is necessary, likewise only rotating the adjustment base 23 is enough.

Although the present invention has been explained in relation to its preferred embodiments, it is to be understood that many other possible modifications and variations can be made without departing from the scope of the invention as hereinafter claimed.

What is claimed is:

1. A position adjustment mechanism for grinding wheels, comprising:

a rotating body, including a fixing surface and a first thread portion;

a first grinding unit, including a fixing portion and a first grinding portion, wherein the fixing portion is fixedly engaged with the fixing surface of the rotating body;

a second grinding unit, including a second thread portion and a second grinding portion, wherein the second thread portion is threadedly engaged with the first thread portion, and wherein the first and the second grinding portions have different diameters from each other, and are spaced from each other axially and have different grinding precisions; and a fixing nut, being threadedly engaged with the first thread portion, and pressing axially against the second grinding unit.

2. The position adjustment mechanism for grinding wheels as claimed in claim 1, wherein the second grinding unit includes a sand wheel and an adjustment base, and the sand wheel is coaxially fixed on the adjustment base, and the adjustment base has a hollow structure such that the second thread portion is formed at an inner wall of the hollow structure.

3. The position adjustment mechanism for grinding wheels as claimed in claim 2, wherein the rotating body further includes a motor spindle and a flange, wherein the flange is coaxially fastened to an end of the motor spindle, and both the fixing surface and the first thread portion are located on a surface of the flange.

4. The position adjustment mechanism for grinding wheels as claimed in claim 2, wherein the first grinding unit relates to a sand wheel such that the first grinding unit has a diameter of abrasive grains smaller than that of the second grinding unit.

5. The position adjustment mechanism for grinding wheels as claimed in claim 1, wherein the rotating body further includes a motor spindle, a flange, and an adjustment base, wherein the flange is coaxially fastened to an end of the motor spindle and has a thread recess such that the adjustment base is threadedly engaged into the thread recess, and wherein the first thread portion is located at circumference of the adjustment base, and the fixing surface is located on a surface of the flange.

6. The position adjustment mechanism for grinding wheels as claimed in claim 5, wherein the first and the second grinding units each includes a sand wheel such that the sand wheel of the first grinding unit has a diameter of abrasive grains greater than that of the second grinding unit.

7. The position adjustment mechanism for grinding wheels as claimed in claim 1, wherein the rotating body is internally provided with a slurry channel.

* * * * *